US010006149B2

(12) United States Patent
Feng et al.

(10) Patent No.: US 10,006,149 B2
(45) Date of Patent: Jun. 26, 2018

(54) METHOD FOR MANUFACTURING A COMPOSITE FIBER AND A NON-WOVEN SUBSTRATE

(71) Applicant: San Fang Chemical Industry Co., Ltd., Kaohsiung (TW)

(72) Inventors: Chung-Chih Feng, Kaohsiung (TW); Chih-Yi Lin, Kaohsiung (TW); Kao-Lung Yang, Kaohsiung (TW)

(73) Assignee: SAN FANG CHEMICAL INDUSTRY CO., LTD., Kaohsiung (TW)

( * ) Notice: Subject to any disclaimer, the term of this patent is extended or adjusted under 35 U.S.C. 154(b) by 213 days.

(21) Appl. No.: 15/059,061

(22) Filed: Mar. 2, 2016

(65) Prior Publication Data

US 2016/0177472 A1 Jun. 23, 2016

Related U.S. Application Data

(62) Division of application No. 14/037,813, filed on Sep. 26, 2013.

(30) Foreign Application Priority Data

Sep. 28, 2012 (TW) ..... 101135703 A

(51) Int. Cl.

| | |
|---|---|
| ***D01D 5/32*** | (2006.01) |
| ***D01F 8/04*** | (2006.01) |
| ***D01F 8/06*** | (2006.01) |
| ***D01F 8/12*** | (2006.01) |
| ***D01F 8/14*** | (2006.01) |

(Continued)

(52) U.S. Cl.

CPC ..... *D01D 5/34* (2013.01); *D01D 5/082* (2013.01); *D01D 5/423* (2013.01); *D02G 3/045* (2013.01); *D02G 3/36* (2013.01); *D04H 1/541* (2013.01); *D04H 3/033* (2013.01); *D10B 2331/02* (2013.01); *D10B 2331/04* (2013.01); *Y10T 428/2929* (2015.01); *Y10T 442/611* (2015.04)

(58) Field of Classification Search

CPC .. D01D 5/32; D01D 5/423; D01F 8/04; D01F 8/06; D01F 8/12; D01F 8/14; D04H 3/005; D04H 3/007; D04H 3/009; D04H 3/011; D04H 3/11

USPC ..... 264/103, 147, 172.15, 172.17, 172.18, 264/210.2, 210.8, 211.16, 344; 28/104

See application file for complete search history.

(56) References Cited

U.S. PATENT DOCUMENTS 4,460,649 A * 7/1984 Park ..... D01D 5/30 264/147

2005/0287895 A1* 12/2005 Bansal ..... D01D 5/32 442/361

* cited by examiner

*Primary Examiner* — Leo B Tentoni

(74) *Attorney, Agent, or Firm* — WPAT, P.C., Intellectual Property Attorneys; Anthony King

(57) ABSTRACT

The present invention provides a composite fiber having a high surface area and flexibility and a method for manufacturing the same, and a substrate containing the composite fiber and a method for manufacturing the same. The composite fiber contains a first component and a second component, and has a maximum diameter and a circumference. The first component has a central portion and a plurality of extension portions. A maximum length of the central portion is less than three quarters of the maximum diameter. The first component is in an amount of 50 wt % to 95 wt %, based on the total weight of the composite fiber. The second component has a plurality of outer portions disposed between two extension portions, and the second component is in an amount of 5 wt % to 50 wt %, based on the total weight of the composite fiber.

4 Claims, 3 Drawing Sheets

(51) Int. Cl.

| | |
|---|---|
| ***D04H 3/005*** | (2012.01) |
| ***D04H 3/007*** | (2012.01) |
| ***D04H 3/009*** | (2012.01) |
| ***D04H 3/011*** | (2012.01) |
| ***D04H 3/11*** | (2012.01) |
| ***D01D 5/34*** | (2006.01) |
| ***D02G 3/36*** | (2006.01) |
| ***D01D 5/08*** | (2006.01) |
| ***D04H 3/033*** | (2012.01) |
| ***D02G 3/04*** | (2006.01) |
| ***D01D 5/42*** | (2006.01) |
| ***D04H 1/541*** | (2012.01) |

METHOD FOR MANUFACTURING A COMPOSITE FIBER AND A NON-WOVEN SUBSTRATE

CROSS-REFERENCE TO RELATED APPLICATIONS

This application claims priority to, and is a Divisional of, U.S. patent application Ser. No. 14/037,813, filed on Sep. 26, 2013, now abandoned, which claims priority to Taiwan Patent Application No. TW 101135703, filed on Sep. 28, 2012, which are hereby incorporated by reference in their entirety.

BACKGROUND OF THE INVENTION

1. Field of the Invention

The present invention relates to a composite fiber and a method for manufacturing the same, and a substrate containing the composite fiber and a method for manufacturing the same. In particular, the present invention relates to a composite fiber having a high surface area and high flexibility and a method for manufacturing the same, and a substrate containing the composite fiber and a method for manufacturing the same.

2. Description of the Related Art

FIG. 1 is a schematic cross-sectional view of conventional composite fibers as disclosed in US Patent Publication No. US2008/0108265, titled "Method for Manufacturing High Surface Area Fiber and Textile" and US Patent Publication No. US2008/0105612, titled "Composite Filter Media with High Surface Area Fibers". According to these patents, by adopting a sea-island composite fiber technology, a composite fiber 1 is formed when an island component 10 is wrapped by a sea component 11. A cross section of the composite fiber 1 is in an oval shape or oblong shape. The island component 10 is in a centipede-like shape, and includes a central portion 12 and a plurality of extension portions 13. The sea component 11 wraps completely around the central portion 12 and the extension portions 13. There is a maximum length $L_1$ of the central portion 12 and a maximum length $L_2$ of the sea component 11, wherein $L_1$ is approximately 80% of $L_2$.

A plurality of composite fibers 1 may be used to manufacture a textile, the textile is subjected to a dissolving and removing processing, and the sea component 11 is dissolved and removed to obtain a fiber shaped in the centipede-like arrangement (only the island component 10 is left). The fiber has many whiskers (the extension portions 13), providing a high surface area.

Since the cross section of the conventional composite fiber 1 is in an oval shape or oblong shape, the ratio of the major axis to the minor axis is excessively large, so the composite fiber 1 will be deformed when an external force is applied. Therefore, the composite fiber 1 cannot be easily processed by methods such as false twist and weaving in post processing. In addition, since the sea component 11 is required to completely wrap the island component 10, the ratio of the dimensions of the sea component 11 cannot be too low, meaning that the ratio of the dimensions of the sea component 11, which has to be dissolved and removed, is high. Furthermore, in a textile manufactured by the composite fiber 1, the stiffness of a small unit of the island component 10 is high and its flexibility is poor due of its H-like shape.

Therefore, to solve the aforementioned problems, it is necessary to provide an innovative and inventive composite fiber having both a high surface area and flexibility and a method for manufacturing the same, and a substrate containing the composite fiber and a method for manufacturing the same.

SUMMARY OF THE INVENTION

The present invention provides a composite fiber having a high surface area and flexibility, having a cross section in a substantially circular shape, and having a maximum diameter and a circumference. The composite fiber includes a first component and a second component. The first component has a central portion and a plurality of extension portions. The maximum length of the central portion is less than three quarters of the maximum diameter. The extension portions extend from the central portion to the circumference. The first component is in an amount of 50 wt % to 95 wt %, based on the total weight of the composite fiber. The second component has a plurality of outer portions, and each outer portion is in a fan shape. Each outer portion is disposed between two extension portions. The extension portions and the outer portions are alternately distributed in the circumference. The second component is in an amount of 5 wt % to 50 wt %, based on the total weight of the composite fiber.

The present invention further provides a method for manufacturing a composite fiber having a high surface area and flexibility, which includes: (a) providing a first component, where the first component has a first viscosity; (b) melting the first component and transferring the melted first component to a spin beam, and setting a first temperature; (c) providing a second component, where the second component has a second viscosity, and the second viscosity is greater than the first viscosity: (d) melting the second component and transferring the melted second component to the spin beam, and setting a second temperature, where the second temperature is lower than the first temperature; and (e) co-extruding the first component and the second component, to form the composite fiber described above.

The present invention further provides a non-woven substrate, which includes a plurality of first fibers and a plurality of second fibers. Each first fiber has a central portion and a plurality of extension portions that extend outwards from the central portion. The outer edges of the extension portions form a discontinuous circumference which can be seen in a cross section of the first fiber. The circumference is in a substantially circular shape and has a maximum diameter. The maximum length of the central portion is less than three quarters of the maximum diameter. Each second fiber is in a fan shape and has a size matching with a space between two extension portions.

The present invention further provides a method for manufacturing a non-woven substrate, which includes: (a) providing a first component, where the first component has a first viscosity; (b) melting the first component, transferring the melted first component to a first spin beam, and setting a first temperature; (c) providing a second component, where the second component has a second viscosity, and the second viscosity is greater than the first viscosity; (d) melting the second component, transferring the melted second component to a second spin beam, and setting a second temperature, where the second temperature is lower than the first temperature; (e) co-extruding the first component and the second component to form the composite fiber described above; (f) forming a fiber web with a plurality of composite fibers; and (g) separating the first component and the second component in the composite fibers, to form a non-woven substrate.

In the present invention, the first fiber (the first component) has many whiskers, which provides a high surface area and in turn provides a high filterability. In addition, the second fiber (the second component) is a superfine fiber, which provides flexible property for the substrate. Therefore, the composite fiber and non-woven substrate of the present invention is capable of having both a high surface area and a high flexibility at the same time.

BRIEF DESCRIPTION OF THE DRAWINGS

The invention will be described according to the appended drawings in which.

PREFERRED EMBODIMENT OF THE PRESENT INVENTION

Figure 1:
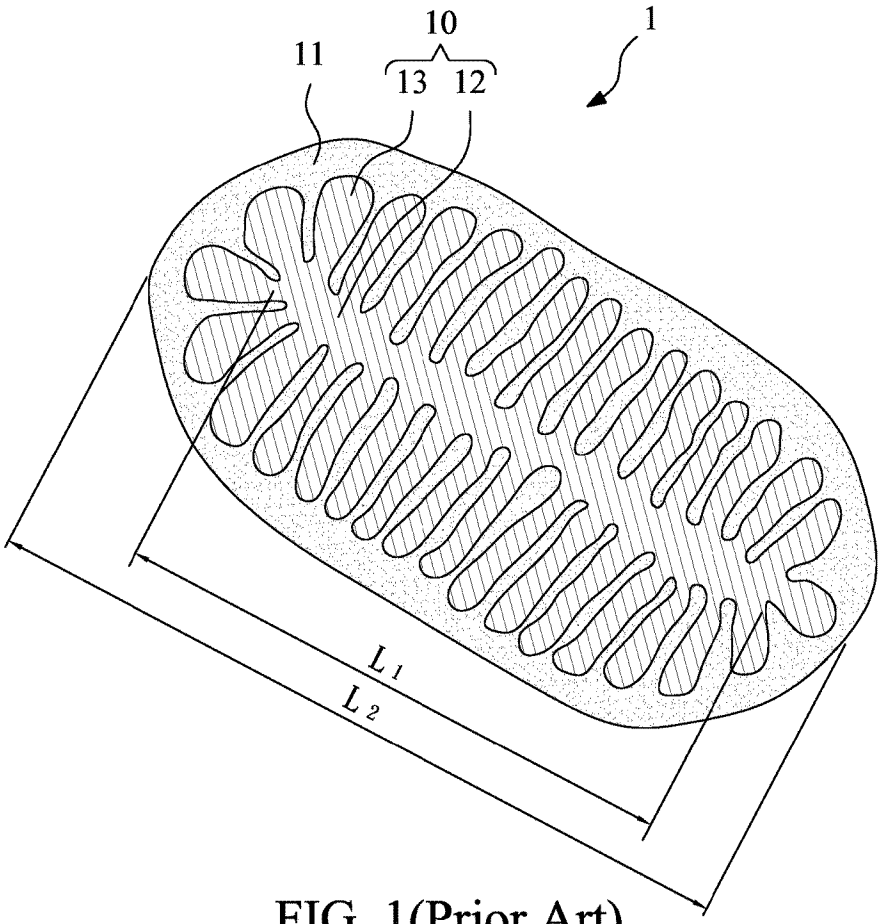
FIG. 1(Prior Art)
FIG. 1 is a schematic cross-sectional view of conventional composite fibers disclosed in US Patent Publication No. US2008/0108265, titled "Method for Manufacturing High Surface Area Fiber and Textile" and No. US2008/0105612, titled "Composite Filter Media with High Surface Area Fibers"
Figure 2:
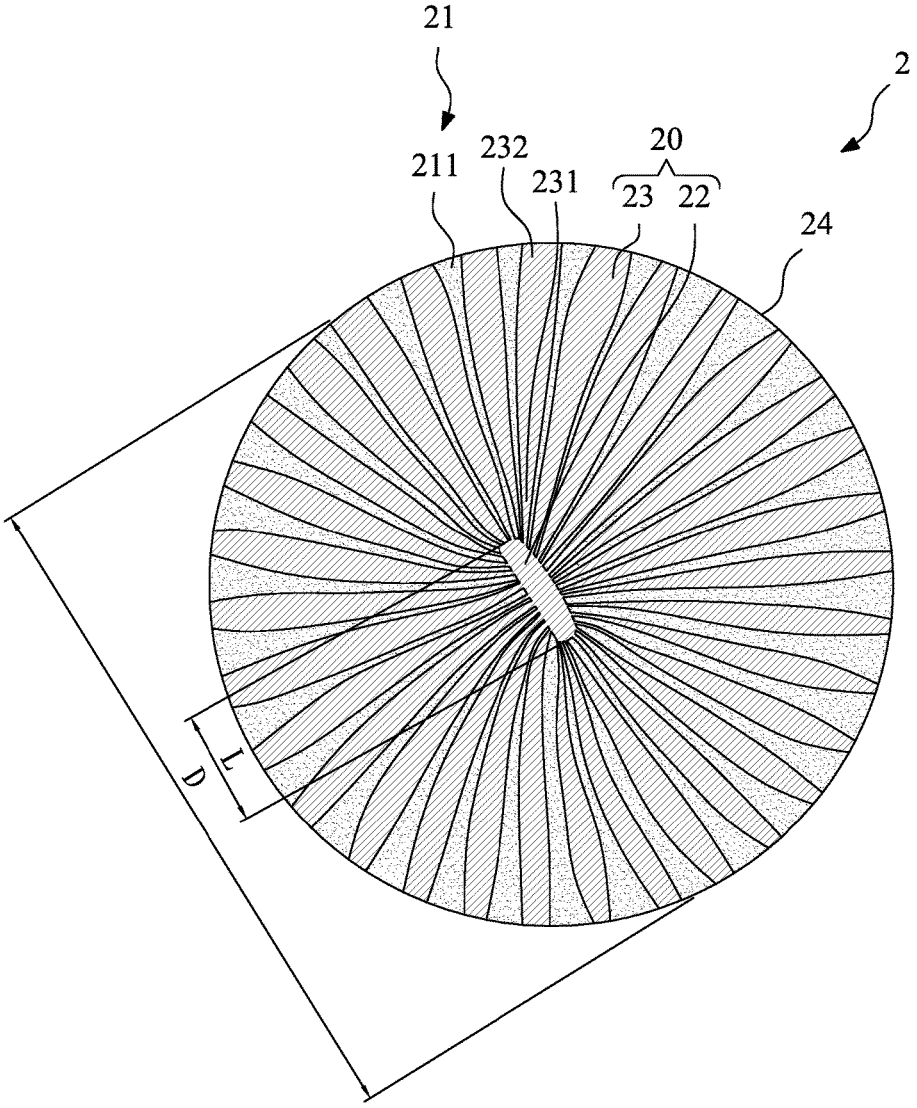
FIG. 2 is a schematic cross-sectional view of an embodiment of a composite fiber having a high surface area and flexibility according to the present invention.

FIG. 2 is a schematic cross-sectional view of an embodiment of a composite fiber having a high surface area and flexibility according to the present invention. Referring to FIG. 2, the composite fiber 2 has a substantially circular cross section, a maximum diameter D, and a maximum circumference 24. The composite fiber 2 includes a first component 20 and a second component 21. The first component 20 has a central portion 22 and a plurality of extension portions 23. A maximum length L of the central portion 22 is less than three quarters of the maximum diameter D, and is greater than one-eighth of the maximum diameter D. The maximum length L is, preferably, approximately one-sixth of the maximum diameter D. The extension portions 23 extend outwards from the central portion 22 to the circumference 24. The first component 20 is in an amount of 50 wt % to 95 wt %, based on the total weight of the composite fiber 2.

In this embodiment, the material of the first component 20 is a polyester polymer, polyamide polymer, or polyolefin polymer. The polyester polymer is Polyethylene terephthalate (PET), Polybutylene terephthalate (PBT), Polytrimethylene terephthalate (PTT), and a modified polymer or copolymer thereof. The polyamide polymer is polyamide 6 (PA6), polyamide 66 (PA66), polyamide 12 (PA12), and a modified polymer or copolymer thereof. The polyolefin polymer is polypropylene (PP). Each extension portion 23 has a first end 231 and a second end 232. The first end 231 is close to the central portion 22, and the second end 232 is close to the circumference 24. The width of the second end 232 is greater than the width of the first end 231, so all the extension portions 23 are in a fan shape or a water drop shape. In addition, as shown in FIG. 2, a part of the extension portions 23 are in an arc shape.

The second component 21 has a plurality of outer portions 211, and each outer portion 211 is in a fan shape. Each outer portion is disposed between two extension portions 23. The first component 20 does not completely wrap the second component 21, so the extension portions 23 and the outer portions 211 are alternately distributed in the circumference 24. The second component 21 is in an amount of 5 wt % to 50 wt %, based on the total weight of the composite fiber 1. In this embodiment, the material of the second component 21 is either nylon or a polyolefin polymer. The polyolefin polymer can be polyethylene (PE), polypropylene (PP), a modified polymer, or a copolymer thereof. It should be noted that, the conglutination between the second component 21 and the first component 20 could not too high because the second component 21 has to be separated from the first component 20 in a substrate process.

The present invention further relates to a method for manufacturing a composite fiber having a high surface area and flexibility, which includes the following steps. First, a first component 20 is provided. The first component 20 has a first viscosity. In this embodiment, the material of the first component 20 is a polyester polymer, polyamide polymer or polyolefin polymer. The polyester polymer is PET, PBT, PTT, and a modified polymer or copolymer thereof. The polyamide polymer is PA6, PA66, PA12, and a modified polymer or copolymer thereof. The polyolefin polymer is PP.

Next, the first component 20 is melted by an extruder, and the melted first component 20 is transferred to a first spin beam. A first temperature is set.

Then, a second component 21 is provided. The second component 21 has a second viscosity that is greater than the first viscosity. In this embodiment, the material of the second component 21 is nylon or a polyolefin polymer. The polyolefin polymer is PE, PP, and a modified polymer or copolymer thereof.

Then, the second component 21 is melted by using an extruder, and the melted second component 21 is transferred to a second spin beam. A second temperature that is lower than the first temperature is set to improve the viscosity of the second component 21.

Afterwards, the composite ratio of the first component 20 and the second component 21 is adjusted, wherein the first component 20 is in an amount of 50 wt % to 95 wt %, and the second component 21 is in an amount of 5 wt % to 50 wt %. Next, the first component 20 and the second component 21 are co-extruded by a bicomponent spinning pack to form the composite fiber 2, wherein the first component 20 is in an amount of 50 wt % to 95 wt % of the total weight of the composite fiber 2, and the second component 21 is in an amount of 5 wt % to 50 wt %, based on the total weight of the composite fiber 2.

The present invention further relates to a method for manufacturing a non-woven substrate, which includes forming a fiber web with a plurality of composite fibers 2 as described above. In an embodiment, to form the fiber web, a staple fiber is formed from the composite fibers 2, and then subjected to a non-woven fabric manufacturing process, which includes opening, carding, crosslapping, needle punched, etc. In another embodiment, a spunbond process is used to directly form the fiber web.

Figure 3:
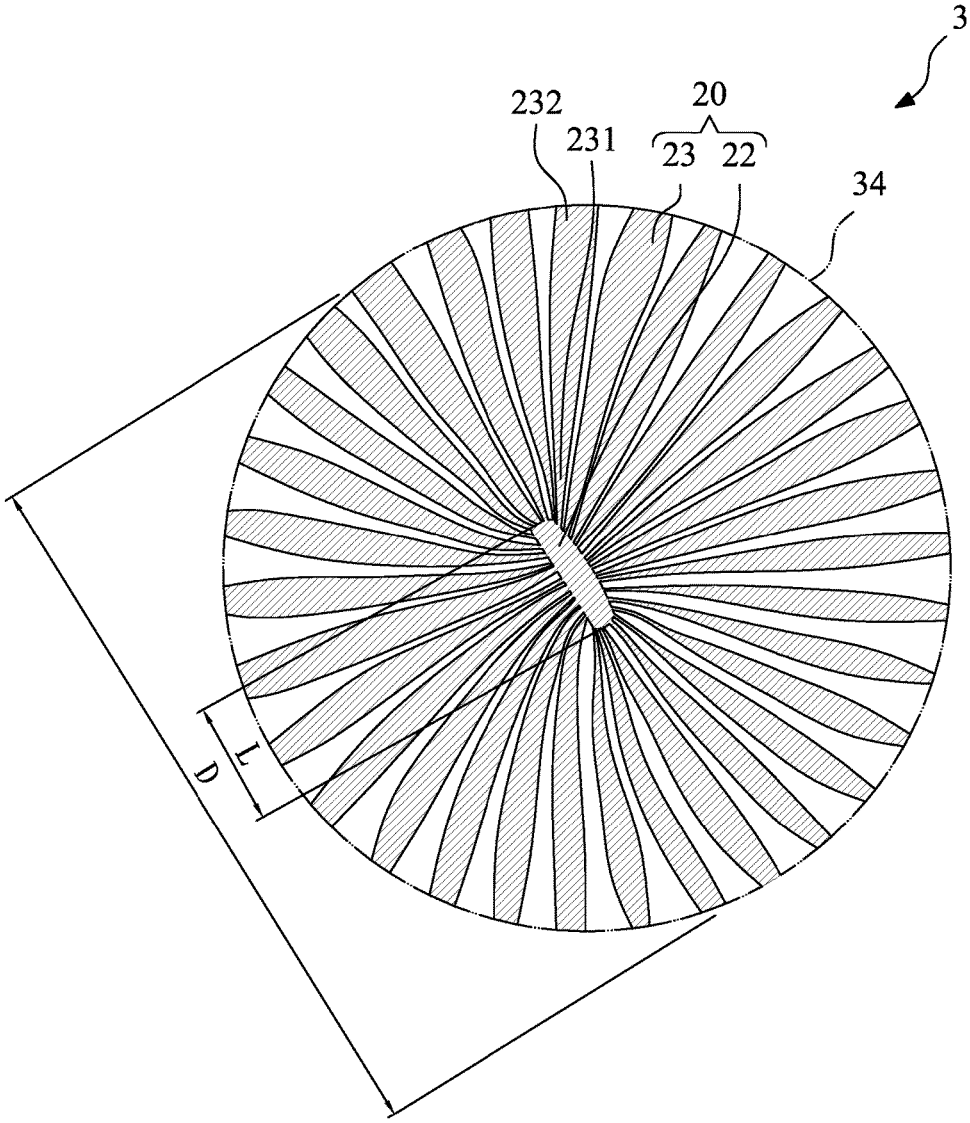
FIG. 3 is a schematic cross-sectional view of an embodiment of a first fiber of a non-woven substrate having a high surface area and flexibility according to the present invention.

Next, the first component 20 and the second component 21 in the composite fibers 2 are separated to form a non-woven substrate. The separation method includes, but is not limited to, microwaving, mechanical beating, mechanical rubbing, high-pressure water jet punching, chemical swelling, and sodium hydroxide solution removal processing. Additionally, referring to FIG. 3, in the non-woven substrate, a first fiber 3 is formed with the first component 20. Each first fiber 3 has a central portion 22 and a plurality of extension portions 23 that extend outwards from the central portion 22. The outer edges of the extension portions 23 form a discontinuous circumference 34 on a cross section of the first fiber 3, and the circumference 34 is substantially in a circular shape and has a maximum diameter D. The maximum length L of the central portion 22 is less than three quarters but greater than one-eighth of the maximum diameter D. The maximum length L is, preferably, approximately one-sixth of the maximum diameter D.

Each extension portion 23 has a first end 231 and a second end 232. The first end 231 is close to the central portion 22, and the second end 232 is close to the circumference 34. The width of the second end 232 is greater than the width of the first end 231, so all the extension portions 23 are in a fan shape or a water drop shape. The first fibers 3 are in an amount of 50 wt % to 95 wt %, based on the total weight of the non-woven substrate.

At the same time, a plurality of second fibers (not shown) is formed by the outer portions 211 of the second component 21. Each second fiber is in a fan shape and has a size matching with a space between two extension portions 23. The second fibers are in an amount of 5 wt % to 50 wt %, based on the total weight of the non-woven substrate.

In the present invention, the first fiber 3 (the first component 20) has many whiskers (the extension portions 23), which provides a high surface area (57.600 $cm^2/g$ to 230.400 $cm^2/g$), and in turn provides a high filterability. In addition, the second fiber (the second component 21) is a superfine fiber that has a degree of fineness found in the 0.01 to 0.001 den range, which provides flexible property for the substrate. Therefore, the composite fiber and non-woven substrate of the present invention is capable of having both a high surface area and a high flexibility at the same time.

Examples are given below to illustrate the present invention, but the present invention is not limited thereto.

Example 1

PBT (manufactured by Chang Chung Group, intrinsic viscosity (IV): 0.83) is dried for 3 hours at 120° C. to have a moisture content of 180 ppm and used as a first component. Nylon (manufactured by BASF AG, relative viscosity (RV): 2.4) is dried for 5 hours at 100° C. to have a moisture content of 110 ppm and used as a second component.

The first component is transferred to a first extruder, and the following temperatures are set in sequence from the entrance of the first extruder: 278° C., 288° C., and 288° C. respectively. The first component is melted and then introduced into a first spin beam whose heat transfer fluid temperature is set to be 288° C. The second component is transferred to a second extruder, and the following temperatures are set in sequence from the entrance of the second extruder: 275° C., 285° C., and 283° C. respectively. The second component is melted and then introduced into a second spin beam whose heat transfer fluid temperature is set to be 280° C.

Then, the first component passes through a first gear pump, and the second component passes through a second gear pump. The first gear pump and the second gear pump are respectively adjusted, so the composite ratio (weight ratio) of the first component is 73%, and the composite ratio (weight ratio) of the second component is 27%. Next, the first component and the second component are co-extruded by a bicomponent spinning pack, and cooling by quench air at a temperature of 22° C. and a relative humidity of 78%. Next, the first component and second component were wound by a winder at a speed of 1620 m/min to obtain a composite fiber having a fineness of 8.5 den, a strength of 1.61 g/den, and an elongation at break of 420%.

First, the composite fiber is washed with warm water at 50° C., and drawing the fiber for 300% in hot water at 85° C. Next, the fiber tow is sprayed with oil by using a sprayer, and sequentially introduced into oven drying zones set at temperatures of 78° C., 80° C., 80° C., 75° C., 70° C., 70° C., 65° C. and 60° C. respectively. Then the fiber tow is cut by a cutter to obtain a staple fiber having a length of 51 mm, a fineness of 2.91 den, a strength of 4.55 g/den, a elongation at break of 48% and a crimp of 9%. The staple fiber is subjected to a non-woven fabric manufacturing process which includes opening, carding, crosslapping, needle punched etc. to form a fiber web having a basis weight of 230 $g/m^2$ and a thickness of 1.4 mm. Then, the fiber web is punched with a water jet of 110 bar to separate the first component and the second component to finally obtain a non-woven substrate having both a superfine fiber (the second fiber) and a high-surface-area fiber (the first fiber).

Example 2

PET (manufactured by Shinkong Synthetic Fibers Co., Ltd., intrinsic viscosity (IV): 0.53) is dried for 4 hours at 130° C. to have a moisture content of 60 ppm, and used as a first component. PP (manufactured by LCY Chemical Corp., melt flow rate (MFR): 25) is used as a second component.

The first component is transferred to a first extruder, and the following temperatures are set in sequence from the entrance of the first extruder: 278° C., 290° C., and 290° C. respectively. The first component is melted and then introduced into a first spin beam, whose heat transfer fluid temperature is set at 292° C. The second component is transferred to a second extruder, and the following temperatures are set in sequence from the entrance of the second extruder: 190° C., 230° C., and 230° C. respectively. The second component is melted and then introduced into a second spin beam whose heat transfer fluid temperature is set at 265° C.

Then, the first component passes through a first gear pump, and the second component passes through a second gear pump. The first gear pump and the second gear pump are respectively adjusted, so the composite ratio (weight ratio) of the first component was 82%, and the composite ratio (weight ratio) of the second component was 18%. Next, the first component and the second component are co-extruded by using a bicomponent spinning pack. The extruded fiber was drawn and cooled by a high-speed flow air and the air pressure of 11 $kg/cm^2$, to obtain a fiber web having a basis weight of 80 $g/m^2$ and a thickness of 0.7 mm. The individual composite fiber has a fineness of 2.2 den, a strength of 2.2 g/den and a breaking elongation of 35%. The fiber web is punched with a water jet of 90 bar to separate the first component and the second component and to obtain a non-woven substrate having both a superfine fiber (the second fiber) and a high-surface-area fiber (the first fiber).

The above embodiments are merely for the purpose of describing the principles and efficacies of the present invention, but are not intended to limit the present invention. Thus, modifications and variations made by those skilled in the art to the above embodiments without departing from the spirit of the present invention shall fall within the scope of the present invention as specified in the following claims.

What is claimed is:

1. A method for manufacturing a composite fiber having a high surface area and flexibility, comprising:

(a) providing a first component, wherein the first component has a first viscosity;

(b) melting the first component, transferring the melted first component to a spin beam, and setting a first temperature;

(c) providing a second component, wherein the second component has a second viscosity, and the second viscosity is greater than the first viscosity;

(d) melting the second component, transferring the melted second component to the spin beam, and setting a second temperature, wherein the second temperature is lower than the first temperature; and (e) co-extruding the first component and the second component to form a composite fiber, wherein the first component is in an amount of 50 wt % to 95 wt %, based on the total weight of the composite fiber, the second component is in an amount of 5 wt % to 50 wt %, based on the total weight of the composite fiber, the cross section of the composite fiber is in a substantially circular shape and has a maximum diameter and a circumference, the first component of the composite fiber has a central portion and a plurality of extension portions extending from the central portion to the circumference, a maximum length of the central portion is approximately one-sixth of the maximum diameter, the second component of the composite fiber has a plurality of outer portions, each outer portion is in a fan shape and is disposed between two extension portions, and the extension portions and the outer portions are alternately distributed in the circumference.

2. The method according to claim 1, wherein the maximum length of the central portion of the composite fiber is greater than one-eighth of the maximum diameter, each extension portion of the composite fiber has a first end and a second end, the first end is close to the central portion, the second end is close to the circumference, the width of the second end is greater than the width of the first end, and the extension portions of the composite fiber are in a fan shape or a water drop shape.

3. A method for manufacturing a non-woven substrate, comprising:

(a) providing a first component, wherein the first component has a first viscosity;

(b) melting the first component, transferring the melted first component to a first spin beam, and setting a first temperature;

(c) providing a second component, wherein the second component has a second viscosity, and the second viscosity is greater than the first viscosity;

(d) melting the second component, transferring the melted second component to a second spin beam, and setting a second temperature, wherein the second temperature is lower than the first temperature;

(e) co-extruding the first component and the second component, to form a composite fiber, wherein the first component is in an amount of 50 wt % to 95 wt %, based on the total weight of the composite fiber, the second component is in an amount of 5 wt % to 50 wt %, based on the total weight of the composite fiber, the cross section of the composite fiber is in a substantially circular shape and has a maximum diameter and a circumference, the first component of the composite fiber has a central portion and a plurality of extension portions extending from the central portion to the circumference, a maximum length of the central portion is approximately one-sixth of the maximum diameter, the second component of the composite fiber has a plurality of outer portions, each outer portion is in a fan shape and is disposed between two extension portions, and the extension portions and the outer portions are alternately distributed in the circumference;

(f) forming a fiber web with a plurality of composite fibers; and (g) separating the first component and the second component in the composite fibers, to form a non-woven substrate.

4. The method according to claim 3, wherein the maximum length of the central portion of the composite fiber is greater than one eighth of the maximum diameter, and in Step (g), the first component and the second component are separated by punching the fiber web with a water jet.

* * * * *